United States Patent [19]

Mansfield

[11] Patent Number: 4,550,517

[45] Date of Patent: Nov. 5, 1985

[54] QUICK-LOADING DEVICE FOR MUZZLE-LOADING RIFLES

[76] Inventor: George F. Mansfield, 236 Greenbriar Dr., Cortland, Ohio 44410

[21] Appl. No.: 511,550

[22] Filed: Jul. 7, 1983

[51] Int. Cl.[4] ..... F42B 39/04; F41C 27/00

[52] U.S. Cl. ..... 42/90

[58] Field of Search ..... 42/90, 87, 88

[56] References Cited

U.S. PATENT DOCUMENTS

| | | | |
|---|---|---|---|
| 11,174 | 6/1854 | Peavey | 42/90 |
| 163,404 | 5/1875 | Phillips | 42/90 |
| 2,508,820 | 5/1950 | Fraley | 42/88 |
| 3,757,449 | 9/1973 | Schindler | 42/87 |
| 4,050,175 | 9/1977 | Mulinix | 42/90 |
| 4,112,606 | 9/1978 | Griffin | 42/90 |
| 4,207,698 | 6/1980 | Burson | 42/90 |
| 4,411,088 | 10/1983 | Wilson | 42/90 |

*Primary Examiner*—Charles T. Jordan

*Attorney, Agent, or Firm*—Michael Williams; Warren N. Low

[57] ABSTRACT

My invention provides a fully-loaded device which is carried by a sportsman in an easily-accessible position for quick reloading of a muzzle-loading rifle. The device comprises a cylinder rotatably carried by a base member, the cylinder having a plurality of elongated openings which are open all the way through the same, and one elongated opening that is closed at its bottom end. The base has an upper flat surface which mates with a lower flat surface of the cylinder, and an off-center opening adapted to be aligned with any one of the elongated openings. The base also has a side opening so that the end of the rifle barrel may be inserted for alignment with the off-center opening. The fully open elongated openings are each adapted to contain black powder, a patch and a ball, while the bottom-closed elongated opening may be used for the storage of tools or the like, or for the storage of flashpan powder in the event the rifle is of the flintlock type. The loading device may be used with either percussion cap or the flintlock rifles and has provision for carrying a plurality of percussion caps, each held within a silicone seal. Indexing means control the revolution of the cylinder so that any one of the elongated openings may be axially aligned with the off-center opening in the base. The powder, patch and ball contained within a fully-open elongated opening may thus be transferred to the gun barrel by means of a conventional ram rod.

9 Claims, 8 Drawing Figures

FIG. 1.
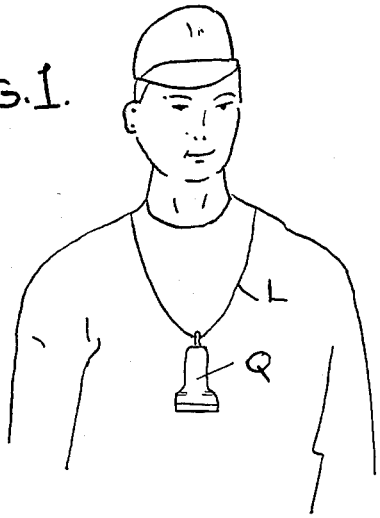
FIG. 2.
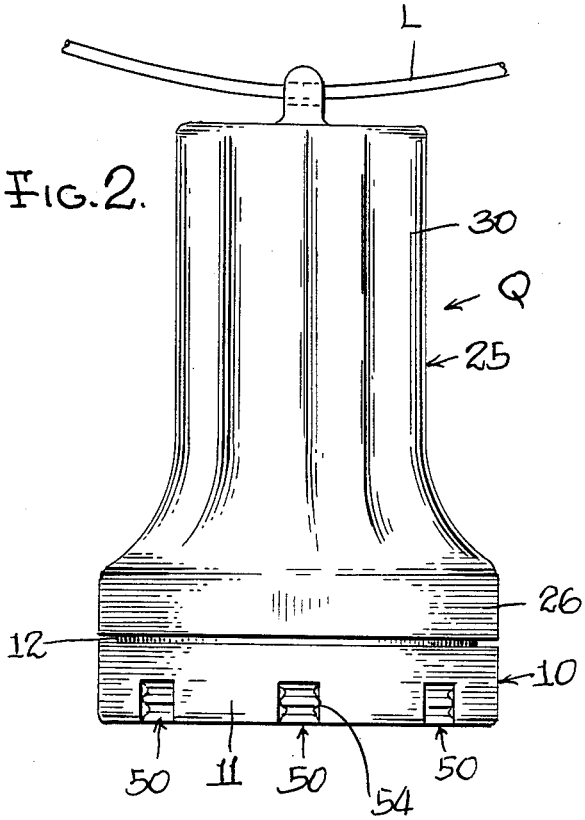
FIG. 3.
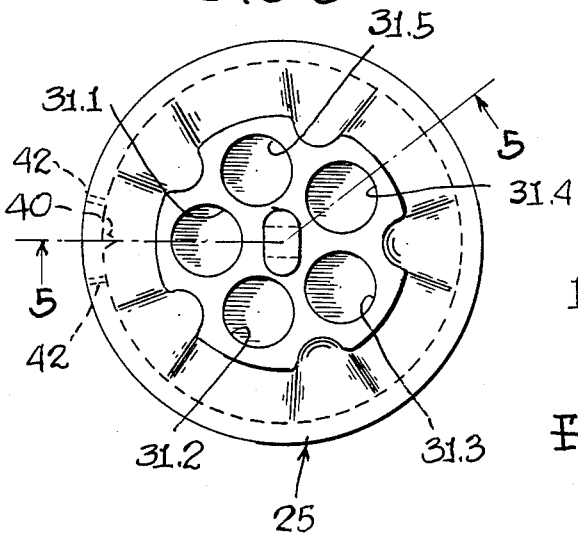
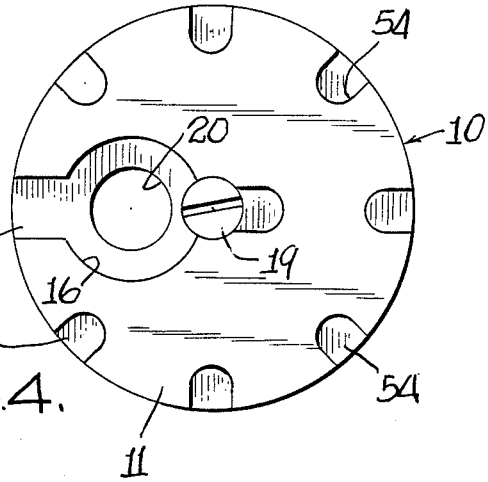
FIG. 4.

QUICK-LOADING DEVICE FOR MUZZLE-LOADING RIFLES

BACKGROUND AND SUMMARY

The prior art includes U. S. Pat. No. 163,404, issued May 18, 1875, to O. D. Phillips for an IMPLEMENT FOR LOADING FIREARMS. This patent, in general, discloses a cylinder rotatably mounted on a base, the cylinder having elongated openings or barrels, each adapted to be charged with powder, ball and wad. The cylinders may be respectively aligned with an opening in the base and the bore of the gun barrel, so that the powder, ball and wad may be transferred to the gun bore.

The Phillips construction, however, lacked many refinements that would make it a usable item in this period of time. Phillips shows six elongated openings or barrels in the cylinder, but one is useless because it cannot be filled with powder since one opening is always axially aligned with the opening in the base and the powder would escape through the base opening. In contrast, my invention provides one elongated opening with a closed inner end so that when this opening is aligned with the base opening, the other openings are temporarily closed by the upper surface of the base. The closed-end opening provides storage for powder or tools, so it has additional utility.

Further, Phillips has no provision for storing percussion caps. Therefore, any time that could be gained by quick transfer of powder, ball and wad to the muzzle of the rifle is defeated by time lost in handling and arranging the percussion caps.

A percussion cap is a small metal cap coated on the inside with an explosive substance. Once the gun is loaded with black powder and ball, one percussion cap is placed over a small tube, called a "nipple", which is located at the breech end of the rifle barrel. This tube leads into the breech end of the barrel where the black powder is packed in place. When the gun trigger is pulled, the hammer is released to strike the cap disposed on the nipple and cause the explosive substance within the cap to explode and send a small flame down through the nipple and into the gun barrel to ignite the main charge.

Percussion caps are very small and difficult to handle and thus much time is spent in seating a cap on a nipple. My invention further provides a cap seal that not only increases the overall size of the cap (making it easier to handle) but seals the nipple/cap interface region to greatly increase the chance of complete ignition. In the case of my improved loading device, a plurality of recesses are formed, each to receive and releasably hold a sealed percussion cap. The construction is such that once the sealed caps are disposed within respective recesses, they need be handled no longer, since the loading device may be grasped by the hand of a user and manipulated to arrange a sealed cap onto the gun nipple. The sealed caps may be used independently of my quick-load device and in either use the seal helps hold the percussion cap in place and seals out troublesome moisture. Other features and advantages of my invention will become evident, from a consideration of the disclosure to follow.

DESCRIPTION OF THE DRAWINGS

In the drawings accompanying this specification and forming a part of this application, there is shown, for purpose of illustration, an embodiment which my invention may assume, and in these drawings:

FIG. 1 is a small-scale view showing how my invention may be worn by a user, FIG. 2 is a full-size side elevational view of the improved quick-loading device, FIG. 3 is a top plan view thereof, FIG. 4 is a bottom plan view thereof, with seals omitted.

DESCRIPTION OF THE PREFERRED EMBODIMENT

Figure 5:
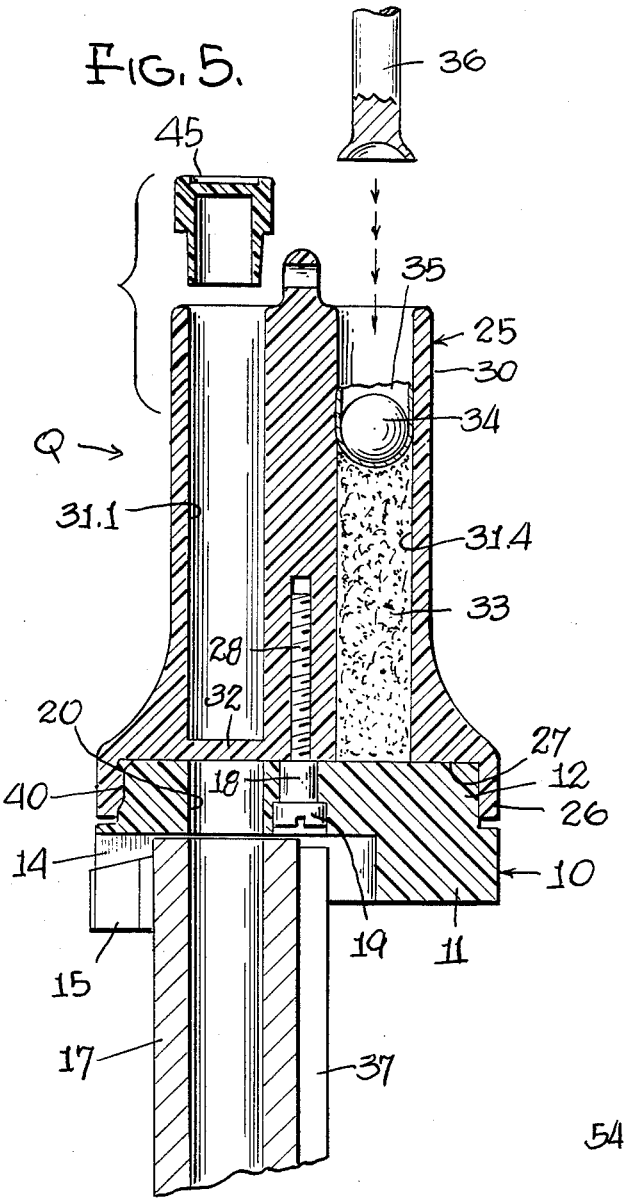
FIG. 5 is a vertical sectional view, corresponding to the line 5—5 of FIG. 3 showing the end of a gun barrel in position for muzzle loading.
Figure 7:
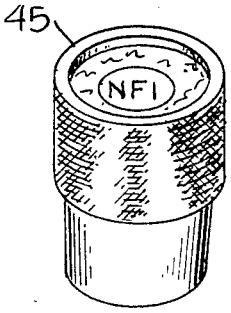
FIG. 7 is a perspective view of a cover shown detached from the assembly in FIG. 5.
Figure 8:
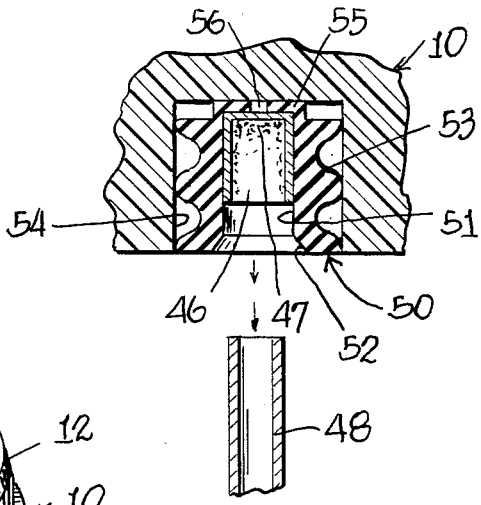
FIG. 8 shows a percussion cap within a seal and ready for assembly with the gun nipple.
Figure 6:
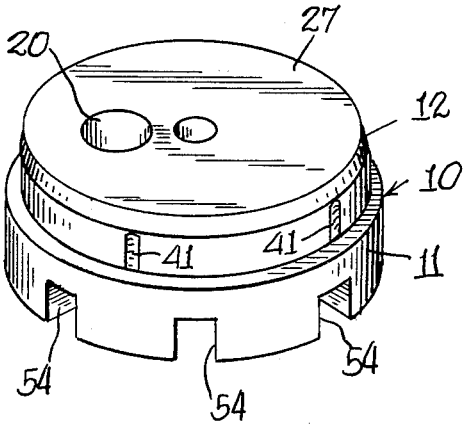
FIG. 6 is a perspective view of the base forming a part of the assembly.

My improved quick-loading device Q may be suspended from a leather thong L, or other flexible support, which extends around the neck of a user, as shown in FIG. 1. The suspension is sufficiently loose enough so that the device Q may be grasped by the hand of a user and moved to fit over a gun barrel, as in FIG. 5, or to position a cap and seal onto the nipple of a gun, as suggested in FIG. 8.

The device comprises a base 10 which is preferably round in plan and which includes a lower portion 11 and an upper portion 12, the latter necessarily being round in plan, and of a reduced diameter. The lower base portion 11, as seen in FIG. 4, has a key-hole slot entering from a side surface, with a narrower entrance portion 14 to receive the gun sight 15 and an enlarged circular portion 16 to receive the end of the gun barrel 17.

The upper base portion 12 has a center hole adapted to receive the unthreaded part 18 of a shoulder bolt 19. The upper base portion 12 also has an off-center hole 20 concentric with the enlarged circular portion 16 and adapted to be axially aligned with the gun barrel when the latter is in position.

A cylinder or drum 25 is rotatably carried by the base 10 and has a lower circular skirt portion 26 closely encircling the round upper portion 12 of the base 10. The top surface of the base portion 12 is smooth and flat and slidably interengages with the smooth flat inner surface 27 of the cylinder. The cylinder has a central threaded hole to receive the threaded end 28 of the shoulder bolt 19 to thereby hold the base and cylinder in assembled relation.

The cylinder and base may be formed of any suitable rigid material and presently a plastic material, such a polypropylene, is preferred.

The cylinder has a neck portion 30 extending upwardly from skirt portion 26 and the neck portion may be vertically fluted for ornamental appearance and to conserve material. The neck portion has a plurality of elongated openings equally spaced about the axis of revolution of the cylinder 25. In the presently disclosed embodiment, five such elongated openings are provided, and are numbered 31.1, 31.2, 31.3, 31.4 and 31.5, as best seen in FIG. 3.

Openings 31.2, 31.3, 31.4 and 31.5 are identical and extend from the top of the cylinder to the surface 27.

Opening 31.1 is slightly different in that it has a bottom closure wall 32. Each of the openings 31.2, 31.3, 31.4 and 31.5 is adapted to contain a measured amount of black powder 33, a ball 34 and a patch or wad 35.

The cylinder may be manually rotated to align any one of the identical openings 31.2–31.5 with the hole 20 in the base, whereupon the powder in that opening drops through hole 20 and into the barrel 17 of the gun. A ram rod 36 of conventional design may be used to ram the ball and patch into the gun barrel and onto the powder to compress the same. When not in use, the ram rod is carried by a holder 37 of conventional construction.

Means are provided to index rotation of the cylinder so that at any time one of the openings 31.1–31.5 is in axial alignment with the hole 20 in the base 10. As presently preferred, the inside surface of skirt wall 26 is formed with a single rib 40 (see FIGS. 3 and 5) which is adapted to releasably seat within any one of five notches 41 in the peripheral surface of the upper portion 12 of the base 10. The notches are spaced in accordance with the spacing between the elongated recesses 31.1–31.5 and the rib 40 is in radial alignment with the hole 20 in base 10 when the closed-bottom elongated opening is axially aligned with the opening 20. The skirt wall 26 has a pair of narrow slots 42 on opposite sides of the rib 40 to permit radial flexing of the wall portion which carries the rib.

The lower portion 11 of the base 10 and the exterior surface of skirt wall 26 may have indicia (not shown) which are aligned when the opening 31.1 is aligned with the hole 20 in the base, to indicate that it is safe to load elongated openings 31.2–31.5 since the lower ends thereof are then closed by the flat upper surface 27 of the base. The opening 31.1 may be used to store black powder, if the gun is of the flintlock type, or may be used to store tools or the like. A cover 45 is provided to close the top of the elongated opening 31.1, the cover having a slightly tapered lower end for a force fit within the opening top end.

As mentioned before, percussion caps are very small and normally consist of a metal cap 46 (see FIG. 8) about 0.167 inches long and about 0.167 inches in diameter (about 4 millimeters). The inside of the cap is coated with an explosive charge 47. Because of the very small size of the percussion caps, many are dropped and lost in the process of trying to place a cap on the nipple 48 of the gun.

My invention includes a seal 50 formed of a resilient material, such as a suitable silicone. The seal has a central opening 51 of a size slightly smaller than the external diameter of the percussion cap 46 so that the latter is held therein by a force fit. The entrance to the opening 51 may be tapered, as at 52, to facilitate assembly of the cap. The seal has circular ribs 53 on its outer periphery to resiliently grip the walls of any one of a plurality of notches 54 formed in the lower portion 11 of the base 10. The seal has a thin closure wall 55 formed with a small opening 56. The hammer (not shown) of the gun is adapted to strike the wall 55 and since the cap wall is against this wall, the explosive coating in the cap will explode and in turn explode the powder charge in the gun barrel.

The cylinder 25 provides a good handhold for use in loading a percussion cap 46 (and seal 50) onto the gun nipple 48, since the lower end of the base 10 may be thrust against the nipple when a cap and seal in one of the base openings 54 is aligned with the nipple. The cap shell will have a friction fit with the nipple and the ribs 53 on the seal will flex to strip from the base opening 54.

The cap and seal assembly may be used independently of my improved quick-load device since the seal increases the overall size of the cap to make it easier to handle. In either case, the seal helps hold the percussion cap in place and covers the nipple/cap interface region to seal out moisture.

I claim:

1. A device for quickly loading a muzzle-loading gun, comprising:

a base, said base having a circular upper portion, a cylinder extending upwardly from said base and revolvable about a pivot axis on said base, said cylinder having a circular skirt portion which closely and slidably receives said base upper portion to assist in guiding revolution of said cylinder thereon, said base having a flat upper surface slidably interengaging with a flat lower surface on said cylinder, said cylinder having a plurality of elongated openings, the longitudinal axes of said openings being parallel to said pivot axis and disposed in a circle concentric with the latter, one of said openings having a bottom wall to close the lower end thereof at all times, the other of said openings being open from top to and through the lower flat surface thereof, said other opening being adapted to receive a charge of powder, ball and patch, said base having an off-center hole therethrough and a recess in its lower surface for receiving the muzzle end of a gun and positioning the same in axial alignment with said hole, said base hole being on a circle having a radius the same as the circle on which said openings are located, whereby said cylinder may be rotated about said pivot axis to align any one of said elongated openings with said base hole, said other of said openings when said one opening is aligned with said base hole being temporarily closed by the flat upper surface of said base, thereby to be in position to receive a charge which may be transferred therefrom to the rifle muzzle by axially aligning one of said other of said openings with said base hole and pushing the charge into the rifle by means of a ram rod.

2. The construction according to claim 1 wherein detent means provide for indexing rotation of said cylinder to releasably hold any one of said openings in axial alignment with said base hole.

3. The construction according to claim 1 wherein said skirt portion has a rib projecting inwardly from its inner surface, and wherein said base circular upper portion has a plurality of notches in its peripheral surfaces, the notches being of a number equal to the number of said elongated openings and spaced correspondingly, said rib being adapted to seat within any one of said notches to releasably hold any one of said openings in axial alignment with said base hole.

4. The construction according to claim 3 wherein said skirt portion has a pair of slits disposed on opposite sides of said rib to facilitate lateral flexing of the latter.

5. The construction according to claim 1 wherein said one of said elongated openings is adapted to store powder or tools or the like, and a cap for closing said one opening and having a tapered end portion constructed and arranged to have friction fit therewith.

6. The construction according to claim 1 and further including a plurality of pockets in said base, constructed and arranged so that each is adapted to receive and store a percussion cap.

7. The construction according to claim 6 wherein each percussion cap is contained within a pliable rubber shell, the rubber being compressed when pushed into a base pocket to thereby releasably hold the shell in the pocket.

8. The construction according to claim 6 wherein said pockets open from the lower surface of said base and wherein said percussion caps are stored within respective pockets with the open cap end accessible for disposition of said cap onto the percussion-cap-receiving nipple of said gun.

9. A holder for a percussion cap, the latter being adapted to be mounted on a receiving nipple of a muzzle-loading gun in position to be struck by the hammer of said gun, said holder comprising a pliable rubber shell into which the cap is forced with its closed end against the closed end of said shell, said rubber shell having a ribbed exterior surface, and said shell, with assembled percussion cap, being adapted for close fit within a storage pocket, the ribs on said exterior surface deflecting to grip the surface of said storage pocket to releasably hold said shell therein, said inserted cap flexing and increasing the size of the said shell to improve handling capability and sealing the nipple/cap interface region against entrance of moisture.

* * * * *